United States Patent [19]

Rezanka

[11] 4,272,184

[45] Jun. 9, 1981

[54] CONDUCTIVE CARRIER FOR MAGNETIC BRUSH CLEANER

[75] Inventor: Ivan Rezanka, Pittsford, N.Y.

[73] Assignee: Xerox Corporation, Stamford, Conn.

[21] Appl. No.: 80,762

[22] Filed: Oct. 1, 1979

[51] Int. Cl.[3] ..... G03G 21/00

[52] U.S. Cl. ..... 355/15; 15/256.52; 118/652

[58] Field of Search ..... 355/3 R, 3 DD, 15; 118/652; 15/256.51, 256.52

[56] References Cited

U.S. PATENT DOCUMENTS

| | | | |
|---|---|---|---|
| 2,911,330 | 11/1959 | Clark | 134/1 |
| 3,580,673 | 5/1971 | Yang | 355/15 |
| 3,700,328 | 10/1972 | Davidge et al. | 355/15 |
| 3,713,736 | 1/1973 | Sargis | 355/15 |
| 3,918,808 | 11/1975 | Narita | 355/15 |
| 3,950,089 | 4/1976 | Fraser et al. | 355/3 DD |
| 4,006,987 | 2/1977 | Tomono et al. | 355/15 |
| 4,043,298 | 8/1977 | Swackhamer | 355/15 X |
| 4,116,555 | 9/1978 | Young et al. | 355/3 DD X |
| 4,127,327 | 11/1978 | Rezanka | 355/15 |
| 4,142,165 | 2/1979 | Miyakawa et al. | 355/15 X |

*Primary Examiner*—Fred L. Braun

*Attorney, Agent, or Firm*—P. H. Kondo; R. J. Grandmaison; E. O. Palazzo

[57] ABSTRACT

An electrostatographic development and cleaning system employing conductive carrier particles. The carrier particles comprise a core having magnetic or magnetically-attractable properties which is coated with a polymer to provide particles having a resistivity of less than about $10^{10}$ ohm-cm. The carrier particles also provide efficient removal of residual toner deposits from a photoreceptor surface after a copying operation.

11 Claims, 2 Drawing Figures

CONDUCTIVE CARRIER FOR MAGNETIC BRUSH CLEANER

This invention relates to electrostatographic imaging systems and, more specifically, to development and cleaning systems which employ conductive carrier particles.

In a conventional electrostatographic printing process of the type described in Carlson's U.S. Pat. No. 2,297,691 on "Electrophotography", a uniformly charged imaging surface is selectively discharged in an image configuration to provide an electrostatic latent image which is then developed through the application of a finely-divided, coloring material, called "toner". As is known, that process may be carried out in either a transfer mode or a non-transfer mode. In the non-transfer mode, the imaging surface serves as the ultimate support for the printed image. In contrast, the transfer mode involves the additional steps of transferring the developed or toned image to a suitable substrate, such as a plain paper, and then preparing the imaging surface for re-use by removing any residual toner particles still adhering thereto.

As indicated, after the developed image has been transferred to a substrate, some residual toner usually remains on the imaging surface. The removal of all or substantially all of such residual toner is important to high copy quality since unremoved toner may appear in the background in the next copying cycle. The removal of the residual toner remaining on the imaging surface after the transfer operation is carried out in a cleaning operation.

In present day commercial automatic copying and duplicating machines, the electrostatographic imaging surface, which may be in the form of a drum or belt, moves at high rates of speed in timed unison relative to a plurality of processing stations around the drum or belt. This rapid movement of the electrostatographic imaging surface has required vast amounts of toner to be used during the development period. Thus, to produce high quality copies, a very efficient background removal apparatus or imaging surface cleaning system is necessary. Conventional cleaning systems have not been entirely satisfactory in this respect. Most of the known cleaning systems usually become less efficient as they become contaminated with toner thus necessitating frequent service of the cleaning system. As a result, valuable time is lost during "down time" while a change is being made. Also, the service cost of the cleaning system increases the per copy cost in such an apparatus. Other disadvantages with the conventional "web" type or the "brush" type cleaning apparatus are known to the art.

One of the preferred vehicles for delivering the toner needed for development purposes is a multi-component developer comprising a mixture of toner particles and generally large carrier particles. Normally, advantage is taken of a triboelectric charging process to induce electrical charges of opposite polarities onto the toner and carrier particles. To that end, the materials for the toner and carrier components of the developer are customarily selected so that they are removed from each other in the triboelectric series. Furthermore, in making those selections, consideration is given to the relative triboelectric ranking of the materials in order to ensure that the polarity of the charge nominally imparted to the toner particles opposes the polarity of the latent images of interest. Consequently, in operation, there are competing electrostatic forces acting on the toner particles of such a developer. Specifically, there are forces which tend to at least initially attract the toner particles to the carrier particles. Additionally,the toner particles are subject to being electrostatically stripped from the carrier particles whenever they are brought into the immediate proximity of or actual contact with an imaging surface bearing a latent image.

It has also been found that toner-starved carrier particles (i.e., carrier particles which are substantially free of toner) may be employed in cleaning systems to remove residual or other adhering toner particles from an imaging surface. To enhance that type of cleaning, provision is desirably made for treating the unwanted toner particles with a pre-cleaning corona discharge which at least partially neutralizes the electrical charges whch give rise to the forces holding them on the imaging surface, and then the carrier particles are brought into contact with the imaging surface to collect the toner particles.

Heretofore, problems have been encountered in attempting to use electrically conductive carrier particles in systems relying on locally generated electrostatic fields. In particular, experience has demonstrated that conductive carrier particles occasionally cause short circuits which are transitory (typically, having a duration of less than about 50 microseconds), but nevertheless troublesome inasmuch as they upset the electric fields. Proposals have been made to alleviate some of the problems, but the art is still seeking a complete solution. For example, it has been suggested that the development electrode and housing of a development system should be maintained at the same potential, thereby preventing any current flow therebetween even should conductive carrier particles bridge the intervening space. However, that suggestion does not solve the problem which arises when there is a pin hole or other defect in the insulating imaging surface which permits a bridge-like accumulation of carrier particles to establish a short circuit between the electrode and the conductive backing for the imaging surface.

Understandably, therefore, electrically conductive carrier particles are not generally favored. That is unfortunate because conductive materials, such as bare nickel and iron beads, are sometimes the best possible choice for the carrier component. Specifically, there is evidence indicating that electrically conductive carrier particles would not only prolong the useful life of same developer mixtures, but also reduce the background development levels and the edge deletions caused by certain development systems.

PRIOR ART STATEMENT

A number of patents disclose magnetic brush cleaning systems. See, e.g., U.S. Pat. Nos. 2,911,330; 3,580,673; 3,700,328; 3,713,736; 3,918,808; 4,006,987; 4,116,555; and 4,127,327. Briefly, in each of these patents there is disclosed a magnetic brush cleaning system in which a magnetic roller is mounted for rotation and located adjacent to the area of the photoreceptor surface to be cleaned. A quantity of magnetic carrier beads or particles are in contact with the magnetic roller and are formed into streamers or brush configuration. The magnetic roller supporting the brush may be connected to a source of DC potential to exert electrostatic attraction on the residual toner image to be cleaned. Thus, the magnetic brush removes toner from the imaging surface bg mechanical, electrostatic, and triboelectric forces.

In the magnetic brush cleaning devices of the prior art, the magnetic brush may be located either above the photoreceptor surface to be cleaned or it may be located elevationally at or below the photoreceptor. Compare FIGS. 1 and 2 of U.S. Pat. No. 2,911,330. When the magnetic brush is located elevationally at or below the photoreceptor surface area to be cleaned, a reservoir or sump for holding a supply of the magnetic carrier particles may be provided for the formation of the magnetic brush. The relatively large supply of carrier particles in the reservoir permits long operation before the carrier particles are substantially saturated with toner particles and can no longer efficiently clean the photoreceptor surface area. The relatively limited amount of carrier particles such an apparatus can hold limits the period of operation between servicing of the device, which involves removing the spent or used carrier particles and replenishing the magnetic roller with fresh carrier particles. Since in some of the newer copying machines the period between service calls is already to some extent controlled by the cleaning devices, there is a need for efficient cleaning devices which have extended life between service calls.

SUMMARY OF THE INVENTION

Accordingly, it is an object of this invention to provide a development and cleaning system which overcomes the above-noted deficiencies in the prior art.

It is another object of this invention to provide a magnetic brush cleaning system which enables efficient cleaning of an imaging surface for extended periods of time between service calls.

It is another object of this invention to provide carrier particles having conductive characteristics and which do not cause photoreceptor shorting problems.

It is a further object of this invention to provide carrier particles which may be employed with a magnetic brush cleaning system and enable efficient removal of residual toner deposits from photoreceptor surfaces.

It is still a further object of this invention to provide improved developer materials which may be employed in electrostatographic development and cleaning of negatively charged photoreceptor surfaces.

It is another object of this invention to provide electrostatographic cleaner and developer materials having physical and electrostatographic properties superior to those of known cleaner and developer materials.

The above objects, and others, are accomplished, generally speaking, by providing a magnetic brush cleaning system employing polymer coated magnetic or magnetically-attractable carrier particles having electrically conductive properties. Further, the carrier particles have a triboelectric charging response of at least about 15 microcoulombs per gram of toner material when contacted with toner particles.

The features of the present invention will become apparent as the following description proceeds and upon reference to the drawings, in which:

FIG. 1 is a schematic elevational view depicting an electrophotographic printing machine incorporating the elements of the present invention therein; and FIG. 2 is a cross-sectional view of one embodiment of magnetic brush cleaning apparatus employed in the present invention.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the cleaning system of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a flexible belt 10 having a photoconductive surface 12 deposited on a conductive substrate 14. Belt 10 moves in the direction of arrow 16 to advance successive portions of photoconductive surface 12 sequentially through the various processing stations disposed about the path of movement thereof. Belt 10 is entrained about stripping roller 18, tension roller 20, and drive roller 22.

Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced flanges or edge guides 26. Edge guides 26 are mounted on opposed ends of drive roller 22 defining a space therebetween which determines the desired predetermined path of movement for belt 10. Edge guides 26 extend in an upwardly direction from the surface of roller 22. Preferably, edge guides 26 are circular members or flanges.

Belt 10 is maintained in tension by a pair of springs (not shown) resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of belt 10 to a relatively high, substantially uniform potential. A suitable corona generating device is described in U.S. Pat. No. 2,836,725 issued to Vyverberg in 1958.

Next, the charged portion of photoconductive surface 12 is advanced through exposure station B. At exposure station B, an original document 30 is positioned face down upon transparent platen 32. Lamps 34 flash light rays onto original document 30. The light rays reflected from original document 30 are transmitted through lens 36 forming a light image thereof. The light image is projected onto the charged portion of photoconductive surface 12 to selectively dissipate the charge thereon. This photoconductive surface 12 to selectively dissipate the charge thereon. This records an electrostatic latent image on photoconductive surface 12 which corresponds to the informational areas contained within original document 30.

Thereafter, belt 10 advances the electrostatic latent image recorded on photoconductive surface 12 to development station C. At development station C, a magnetic brush developer roller 38 advances a developer mix 39 into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material 40 is moved into contact with the toner powder image. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the photoconductive surface 12 of belt 10 in a timed sequence so that the toner powder image developed thereon contacts the advancing sheet of support material at transfer station D.

Transfer station D includes a corona generating device 50 which sprays ions onto the backside of sheet 40. This attracts the toner powder image from phtoconductife surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to sheet 40. Preferably, fuser assembly 54 includes a heated fuser roller 56 and a back-up roller 58. Sheet 40 passes between fuser roller 56 and back-up roller 58 with the toner powder image contacting fuser roller 56. In this manner, the toner powder image is permanently affixed to sheet 40. After fusing, chute 60 guides the advancing sheet 40 to catch tray 62 for removal from the printing machine by the operator.

Invariably after the sheet of support material is separated from photoconductive surface 12 of belt 10, some residual particles remain adhering thereto. These residual particles are removed from photoconductive surface 12 at cleaning station F. Cleaning station F includes a rotatably mounted magnetic cleaning brush 64 in contact with photoconductive surface 12. The particles are cleaned from photoconductive surface 12 by the counter-rotation of brush 64 in contact therewith. Subsequent to cleaning, a discharge lamp (not shown) floods photoconductive surface 12 with light to dissipate any residual electrostatic charge remainining thereon prior to the charging thereof for the next successive imaging cycle.

It is believed that the foregoing description is sufficient for purposes of the present application to illustrate the general operation of an electrophotographic printing machine.

Referring now to the specific subject matter of the present invention, FIG. 2 depicts cleaning brush 64 in greater detail. The magnetic brush cleaning system comprises a magnetic brush roll having a pluraity of magnet means mounted therein and a reservoir for the cleaning carrier particles of this invention closely spaced from the magnetic brush roll. In FIG. 2, the magnetic brush cleaning apparatus 64 is shown to be located above the photoreceptor surface 12 which is to be cleaned. The photoreceptor 12 has residual toner image areas 65 which must be cleaned before the photoreceptor can be used over again in the next copying cycle. The magnetic brush cleaning apparatus 64 is made of a brush roll 66, detoning roll 68 and a reservoir or sump 70 for the carrier beads.

The brush roll 66 is made of an inner sleeve or support 72 and an outer shell 64. The inner sleeve, which may conveniently be made of such ferro-magnetic materials as cold rolled steel has a number of magnets 76 fixedly mounted on its outer surface. In addition to magnets 76, there are provided a trim magnet 78, a sump exit magnet 80, and a sump magnet 82. The number of magnets mounted on the outside of sleeve 72 may be varied, but the total should be an even number such as six or eight or ten to facilitate the even distribution of the magnetic lines of force. Although the magnets 76 are shown to be separate magnets mounted on the outside of sleeve 72, it will be appreciated that a single magnetizable piece of material, sections of which may be alternately magnetized, may be used. The entire inner sleeve structure is mounted so as to be stationary during the operation of the magnetic brush cleaning apparatus.

The outer shell 74 is preferably concentric to the inner sleeve 72. Outer shell 74 is rotatably mounted on a shaft 84. On the exterior surface of the shell 74, cleaning brush fibers or streamers 86 are formed of carrier particles of this invention.

The reservoir 70 for the carrier particles preferably has a pickoff means 88 and exit means 90 associated therewith. Pickoff means 88, which in its simplest form may be a doctor blade or scraper knife, may be integral with the reservoir 70 or it may be a separately formed member attached to the reservoir for convenient adjustment. Exit means 90 may conveniently be an opening at the bottom of the reservoir 70 with a baffle extending to a predetermined position.

Detoning roll 68 removes toner from the magnetic brush fibers 86 by contact therewith. A scraper 92 removes the toner from the detoning roll 68 for disposal by transporting means 94.

Around the entire outside perimeter of the magnetic brush cleaning apparatus a shield 100 is provided to contain any stray carrier particles which may separate from the outer shell 74 due to the action of stationary magnetic lines of force on the rotating magnetic brush or streamers 86.

When it is desired to load the conductive carrier particles into the magnetic brush cleaning apparatus, a loading door located above the cylinder may be removed and the carrier particles loaded into the apparatus. When the carrier particles are spent, such as due to toner impaction, and it is desired to remove or unload them from the cleaning apparatus, an unloading door is provided in the bottom of the cleaning apparatus housing. This door arrangement provides for easy maintenance of the cleaning apparatus.

The brush roll 66 is generally biased with an appropriate source of DC potential, not shown, to assist the removal of the residual toner image 65 from the photoreceptor 12. Similarly, the detoning roll 68 is negatively biased to exert electrostatic attraction on the toner attached to the magnetic brush on the brush roll 66. For example, with positively charged toner particles, the brush roll 66 may be negatively biased to a potential of about 200 volts with respect to ground, and the detoning roll may be negatively biased to a potential of about 10 volts with respect to brush roll 66.

In operation, magnetic brush bristles 86 are fully formed in the vicinity of sump exit magnet 80, and they contact and clean photoreceptor 12. Upon rotation to the area of trim magnet 78, magnetic brush bristles 86 are partially trimmed or removed by pickoff means 88 but they are renewed by carrier particles from sump 70 through exit means 90 and are again fully formed. Where the magnets are oriented rubber magnets, a magnetic field strength of between about 600 Gauss and about 700 Gauss on the magnetic brush cylinder provides satisfactory results. If the magnets are ceramic materials, a magnetic field strength of between about 1000 Gauss and about 1200 Gauss is likewise satisfactory in the cleaning operation. The magnetic field magnitude plays on important role for containment of cleaning carrier particles and their flow stability, both of which influence the function of the cleaning subsystem. In addition, the spacing latitude between the magnetic brush cylinder and the photoreceptor is reduced when employing the weaker rubber magnets. Further, it is preferred that the magnetic field profile be radial in the contact zone between the photoreceptor and the magnetic brush cylinder, i.e., normal for best results.

Due to the force of the magnets, the magnetic or magnetically-attractable carrier particles adhere to the periphery of the cylinder to form a magnetic brush which brushingly engages with the photoconductive surface and removes therefrom the residual toner particles. In accordance with this invention, a voltage of between about 50 volts and about 400 volts is applied to the cylinder of the cleaning apparatus to attract the residual toner particles from the photoconductive surface to the carrier particles magnetically entrained on the periphery of the cleaning apparatus cylinder. Thus, as the photoconductive surface is moved past the cleaning apparatus, it is contacted by the carrier particles in the form of a magnetic brush which remove substantially all of the residual toner particles from the photoconductive surface. To assist in removing the residual toner particles from the photoconductive surface, the magnetic brush cleaning apparatus is electrically biased to a positive polarity of between about 50 volts and about 400 volts, and preferably in the range of between about 75 volts and about 200 volts.

As the cleaning apparatus cylinder continues to rotate, the carrier beads pass in proximity to a toner reclaim roller which is electrically biased to a negative polarity of up to approximately 400 volts. The reclaim roller serves to attract the positively charged toner particles from the cleaning apparatus cylinder. The reclaim roller rotates in a direction counter to that of the magnetic brush cylinder and the toner particles attracted thereto are removed therefrom by a scraper blade and recovered. The toner reclaim roll may be made of any suitable non-magnetic material. Where the toner reclaim roll is made of metal such as stainless steel, a specific triboelectric charging relationship is important between the toner material and the metal of which the reclaim roll is made. That is, the toner material should be charged by the cleaning carrier particles to the same polarity as it is charged on contact with the reclaim roll. This relationship will enable efficient detoning of the magnetic cleaning brush. Conversely, where the relationship does not exist, extensive accumulation of toner material in the cleaning brush will occur. It is also important that the cleaning carrier particles triboelectrically charge the toner material to the same polarity as the developing carrier particles since, otherwise, material contamination is possible between the development and cleaning subsystems.

Another factor affecting the properties of the cleaning subsystem of this invention is the charge of the residual toner material remaining on the photoreceptor surface after transfer of the developed image. This charge depends on all the prior electrostatographic process steps. As earlier indicated, the cleaning subsystem will efficiently clean the residual toner material where the toner triboelectric charge is in a given range. Improved cleaning subsystem operation is also provided by use of a preclean corotron 67 and a preclean erasure light 69. The role of the preclean corotron serves two purposes; i.e., it shifts the charge of the toner material, and reduces the range of the toner charge as well as influencing its distribution. The main role of the preclean light is to reduce the charge on the photoreceptor where the polarity of the charge and the nature of the photoreceptor conductivity make this possible.

Likewise, the efficiency of the cleaning subsystem of this invention is partially dependent on the process speed of the electrostatographic device. It has been found that both the toner reclaim roll and magnetic brush roll speeds should be approximately the same as that of the photoreceptor for best cleaning results. Generally, cleaning performance improves with increased magnetic brush roll speed; however, carrier particle life, carrier particle loss, and torque extracted from the drive favor the aforementioned brush roll speed. Satisfactory cleaning results have been obtained when the magnetic brush roll speed is between about 1 and 3 inches per second. However, a magnetic brush roll speed of between about 6 inches and about 15 inches per second is preferred in the present system for maximum photoreceptor cleaning efficiency.

As earlier indicated, the carrier particles employed in the cleaning system of this invention have electrically conductive properties and are capable of generating a triboelectric charge of at least about 15 microcoulombs per gram of toner material when contacted therewith. More specifically, the carrier particles of this invention comprise a core particle having magnetic or magnetically-attractable properties which is coated with a coating material to provide carrier particles having a resistivity of less than about $10^{10}$ ohm-cm. The core particle may have an average diameter of from between about 30 microns and about 1,000 microns; however, it is preferred that the core particle have an average diameter of from between about 50 and about 200 microns to minimize toner impaction. Typically, optimum results are obtained when the core has an average particle diameter of about 100 microns.

In accordance with this invention, the core particle having magnetic or magnetically-attractable properties may be selected from iron, steel, ferrite, magnetite, nickel and mixtures thereof. The core particle is initially treated to provide it with a gritty, oxidized surface by conventional means such as by heat-treating in an oxidizing atmosphere.

After the core particle has been provided with an oxidized surface, it is coated with a coating material to provide a carrier particle having a resistivity of between about $10^7$ ohm-cm and about $10^{10}$ ohm-cm. Any suitable thermoplastic or thermosetting resinous coating material may be employed to coat the core particles to provide carrier particles possessing the aforementioned range of resistivity values. However, it is preferred that the resinous coating material be selected from halogenated monomers and copolymers thereof such as polyvinyl chloride-trifluorochloroethylene commercially available as FPC 461 from Firestone Plastics Company, Pottstown, Pa.; polyvinylidene fluoride commercially available as Kynar 201 and Kynar 301F from Pennwalt Corporation, King of Prussia, Pa.; polyvinylidene fluoridetetrafluoroethylene commercially available as Kynar 7201 from Pennwalt Corp.; vinylidene fluoride-chlorotrifluoroethylene commercially available from 3M Company, Minneapolis, Minn.; and vinyl chloride polymers such as Exon 470 commercially available from the Firestone Plastics Company because the carrier particles then possess negative triboelectric charging properties and charge toner particles positively thus are particularly useful in the development of a negatively charged photoconductive surface. Other useful halogenated polymer coating materials include fluorinated ethylene, fluorinated propylene and copolymers, mixtures, combinations or derivatives thereof such as fluorinated ethylene-propylene commercially available from E. I. du Pont Co., Wilmington, Del., under the tradename FEP; trichlorofluoroethylene, perfluoroalkoxy tetrafluoroethylene, and the like.

In preparing the carrier particles, any suitable method may be employed to apply the coating material to the core particles. Typical coating methods include dissolving the coating material in a suitable solvent and exposing the core particles thereto followed by removal of the solvent such as by evaporation. Another method includes in-situ melt-fusing the coating material to the core particles. Suitable means to accomplish the foregoing include spray-drying apparatus, fluid-bed coating apparatus, and mixing apparatus such as available from Patterson-Kelley Co., East Stroudsburg, Pa., As previously indicated, in employing the carrier particles of this invention, it is preferred that the carrier particles be selected so that the toner particles acquire a positive triboelectric charge and the carrier particles acquire a negative triboelectric charge. Thus, by proper selection of the developer materials in accordance with their triboelectric properties, the polarities of their charge when mixed are such that the electroscopic toner particles adhere to the surface of the carrier particles and also adhere to that portion of the electrostatic image-bearing surface having a greater attraction for the toner particles than the carrier particles.

Any suitable finely-divided toner material may be employed with the carrier materials of this invention. Typical toner materials include, for example, gum copal, gum sandarac, rosin, asphaltum, phenol-formaldehyde resins, rosin-modified phenol-formaldehyde resins, methacrylate resins, polystyrene resins, polystyrene-butadiene resins, polyester resins, polyethylene resins, epoxy resins and copolymers and mixtures thereof. Patents describing typical electroscopic toner compositions include U.S. Pat. Nos. 2,659,670; 3,079,342; U.S. Pat. No. Re. 25,136; and U.S. Pat. No. 2,788,288. Generally, the toner materials have an average particle diameter of between about 5 and 15 microns. Preferred toner resins include those containing a high content of styrene because they generate high triboelectric charging values and a greater degree of image definition is achieved when employed with the carrier materials of this invention. Generally speaking, satisfactory results are obtained when about 1 part by weight toner is used with about 10 to 200 parts by weight of carrier material. However, the particular toner material to be used in this invention depends upon the separation of the toner particles from the carrier materials in the triboelectric series. More particularly, the triboelectric charging response between the toner particles and the carrier particles employed in the magnetic brush cleaning system is of extreme importance for maximum cleaning efficiency and system life. That is, the coulomb force exerted by the carrier particles on the toner particles must be capable of overcoming the toner adhesion force to the photoreceptor. For typical toner-cleaning carrier materials, the triboelectric charging response between the carrier and toner material should be at least about 15 microcoulombs per gram of toner material. However, it is preferred that the triboelectric charging response generated between the toner and cleaning carrier materials be at least about 25 microcoulombs per gram of toner material because maximum cleaning efficiency of the photoreceptor and extended lifetime of the cleaning system is thereby obtained.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, iron oxide, Rose Bengal and mixtures thereof. The pigment and/or dye should be present in the toner in a quantity sufficient to render it highly colored so that it will form a clearly visible image on a recording member. Thus, for example, where conventional xerographic copies of typed documents are desired, the toner may comprise a black pigment such as carbon black or a black dye such as Amaplast Black dye, available from National Aniline Products, Inc. Preferably, the pigment is employed in an amount from about 3 percent to about 20 percent by weight, based on the total weight of the colored toner. If the toner colorant employed is a dye, substantially smaller quantities of colorants may be used.

The carrier materials of the instant invention may also be employed to develop electrostatic latent images on any suitable electrostatic latent image-bearing surface including conventional photoconductive surfaces as well as to remove residual toner particles therefrom. Well known photoconductive materials include vitreous selenium, organic or inorganic photoconductors embedded in a non-photoconductive matrix, organic or inorganic photoconductors embedded in a photoconductive matrix, organic or inorganic photoconductors combined with charge transport layers, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

The conductive carrier particles of this invention provide a means for reducing the degrading effects of carrier-caused short circuits while carrying out development and cleaning functions for electrostatographic copying and/or duplicating devices. In addition, the fact that the carrier particles can be used for cleaning allows the cleaning system to use the same carrier particles as in the developer mixture and eliminates contaminating the developer material with cleaner particles and vice-versa. Moreover, the conductive carrier particles of this invention can be used in magnetic brush cleaning systems with extremely good cleaning results while providing substantial savings in materials cost and maintainability over conventional dielectric-coated carrier cleaning systems.

DESCRIPTION OF PREFERRED EMBODIMENTS

The following examples further define, describe and compare methods of preparing the conductive carrier materials of the present invention and of utilizing them to develop electrostatic latent images and to clean photoconductive surfaces. Parts and percentages are by weight unless otherwise indicated.

EXAMPLE I

A developer mixture was prepared as follows. A toner composition was prepared comprising about 10 percent Raven 420 carbon black commercially available from Cities Service Company of Akron, Ohio, about 0.5 percent of Nigrosine Spirit Soluble Black commercially available from American Cyanamid Company of Boundbrook, N.J., and about 89.5 percent of styrene-n-butyl methacrylate (65/35) copolymer resin by melt-blending followed by mechanical attrition. The carrier particles comprised about 98.7 parts of oxidized sponge iron carrier cores available from Hoeganaes Corporation, Riverton, N.J., having an average particle diameter of about 100 microns. A coating composition comprising polyvinyl chloride and trifluorochloroethylene prepared from a material commercially available as FPC 461 from Firestone Plastics Company, Pottstown, Pa., dissolved in methyl ethyl ketone was applied to the carrier cores as to provide them with a coating weight of about 1.3 percent. The coating composition was applied to the carrier cores via solution coating employing a spray dryer. About three parts by weight of the toner composition was mixed with about 100 parts by weight of the carrier particles to form a developer mixture.

Figure 1:
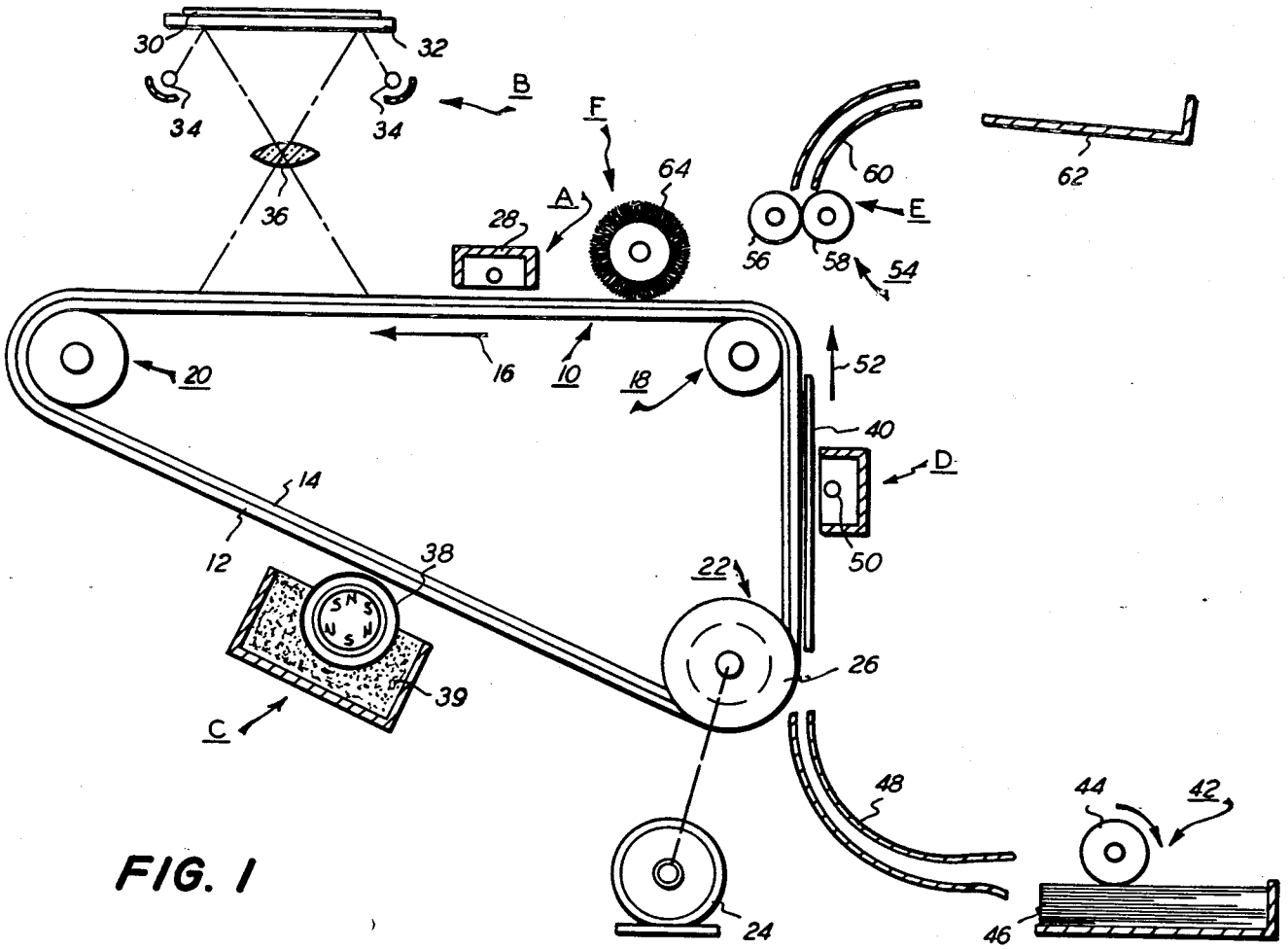
Figure 2:
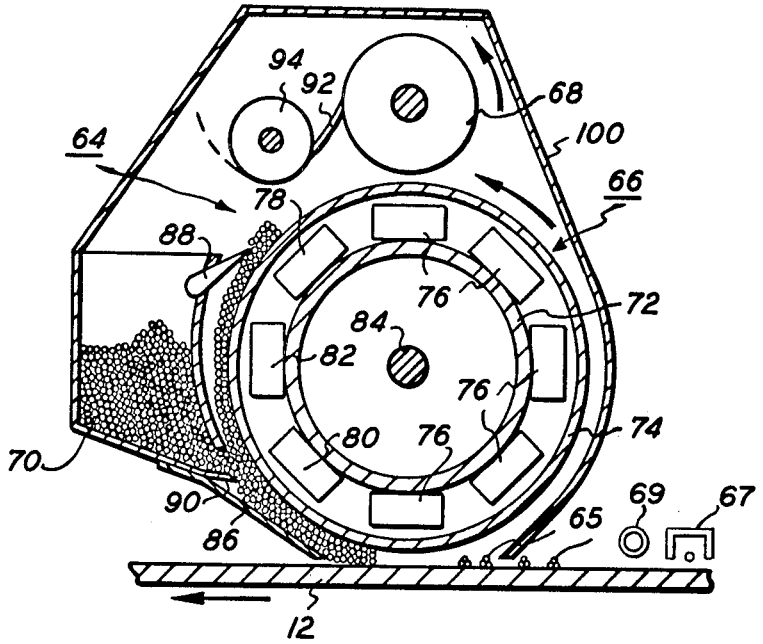

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and the formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 0.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.100 inches, and that between the magnetic brush cleaning roll and the toner reclaim roll was also about 0.100 inches.

The magnetic brush cleaning roll was rotated counter to the direction of the photoreceptor surface at a process speed of about six inches per second. The toner reclaim roll was rotated counter to the direction of the magnetic brush cleaning roll at a process speed of about six inches per second. In addition, a thin, i.e., about 0.003 inch, metal blade was loaded against the toner reclaim roll to remove toner particles from the surface of the toner reclaim roll.

The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that excellent residual toner particle cleaning performance was obtained employing the aforementioned cleaning particles and conditions. Excellent cleaning performance was maintained after the process steps had been repeated about 1500 times and then discontinued.

EXAMPLE II

A developer mixture was prepared as follows. A toner composition was prepared comprising about 6 percent Regal 330 carbon black commercially available from Cabot Corporation, Boston, Mass., about 2 percent of cetyl pyridinium chloride commercially available from Hexcel Company, Lodi, N.J., and about 92 percent of styrene-n-butyl methacrylate (65/35) copolymer resin by melt blending followed by mechanical attrition. The carrier particles comprised about 99.85 parts of oxidized atomized iron carrier cores available from Hoeganaes Corporation, Riverton, N.J., having an average particle diameter of about 100 microns. A coating composition comprising about 0.15 parts of polyvinylidene fluoride commercially available as Kynar 201 from Pennwalt Corporation, King of Prussia, Pa., was applied to the carrier cores by dry-mixing and heat fusion. About three parts by weight of the toner composition was mixed with about 100 parts by weight of the carrier particles to form a developer mixture.

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and the formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 1.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.100 inches, and that between the magnetic brush cleaning roll and the toner reclaim roll was also about 0.100 inches.

The magnetic brush cleaning roll was rotated counter to the direction of the photoreceptor surface at a process speed of about six inches per second. The toner reclaim roll was rotated counter to the direction of the magnetic brush cleaning roll at a process speed of about six inches per second. In addition, a thin, i.e., about 0.003 inch, metal blade was loaded against the toner reclaim roll to remove toner particles from the surface of the toner reclaim roll, The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that excellent residual toner particle cleaning performance was obtained employing the aforementioned cleaning particles and conditions. Excellent cleaning performance was maintained after the process steps had been repeated about 200,000 times and then discontinued.

EXAMPLE III

A developer mixture was prepared as follows. A toner composition was prepared comprising about 6 percent Regal 330 carbon black commercially available from Cabot Corporation, Boston, Mass., about 2 percent of cetyl pyridinium chloride commercially available from Hexcel Company, Lodi, N.J., and about 92 percent of styrene-n-butyl methacrylate (65/35) copolymer resin by melt blending followed by mechanical attrition. The carrier particles comprised about 99.85 parts of oxidized atomized iron carrier cores available from Hoeganaes Corporation, Riverton, N.J., having an average particle diameter of about 100 microns. A coating composition comprising about 0.15 parts of polyvinylidene fluoride commercially available as Kynar 301F from Pennwalt Corporation, King of Prussia, Pa., was applied to the carrier cores by dry-mixing and heat fusion. About three parts by weight of the toner composition was mixed with about 100 parts by weight of the carrier particles to form a developer mixture.

The developer mixture was placed in an electrostatographic copying device equipped with magnetic brush development and cleaning devices as described in FIG. 1 and FIG. 2. The photoreceptor was transported at a process speed of about ten inches per second. After charging, the photoreceptor was exposed to an original document and the formed electrostatic latent image developed with the aforedescribed developer mixture. The developed image was then transferred to a permanent substrate. Examination of the photoreceptor surface revealed residual toner deposits thereon.

The photoreceptor was then transported to the magnetic brush cleaning apparatus station wherein the aforedescribed carrier particles were employed as the cleaning particles. The cleaning carrier particles compacted pile height was maintained at between about 0.080 inches and about 0.120 inches. The magnetic brush roll was negatively biased to about 150 volts. The toner reclaim roll was made of stainless steel and negatively biased to about 20 volts. The spacing between the photoreceptor surface and the magnetic brush cleaning roll was about 0.100 inches, and that between the magnetic brush cleaning roll and the toner reclaim roll was also about 0.100 inches.

The magnetic brush cleaning roll was rotated counter to the direction of the photorceptor surface at a process speed of about six inches per second. The toner reclaim roll was rotated counter to the direction of the nagnetic brush cleaning roll at a process speed of about six inches per second. In addition, a thin, i.e., about 0.003 inch, metal blade was loaded against the toner reclaim roll to remove toner particles from the surface of the toner reclaim roll.

The preclean dicorotron was excited with about a one milliampere AC current at a frequency of about four kilohertz. The dicorotron shield was electrically biased to an average voltage of about 200 volts. The preclean erasure light employed was an incandescent 60 watt lamp.

After passage of the photoreceptor through the cleaning station, it was found that excellent residual toner particle cleaning performance was obtained employing the aforementioned cleaning particles and conditions. Excellent cleaning performance was maintaiined after the process steps had been repeated about 80,000 times and then discontinued.

Although specific materials and conditions are set forth in the foregoing examples, these are merely intended as illustrations of the present invention. Various other suitable thermoplastic resin components, additives, colorants, and process conditions may be substituted for those in the examples with similar results. Other materials may also be added to the toner or carrier to sensitize, synergize or otherwise improve the development or cleaning properties or other desirable properties of the system.

Other modifications of the present invention will occur to those skilled in the art upon a reading of the present disclosure. These are intended to be included within the scope of this invention.

What is claimed is:

1. A magnetic brush cleaning system for removing residual toner particles from a photoreceptor surface in an electrostatographic copying/duplicating machine, said cleaning system comprising;

(a) a magnetic brush roll adapted to rotate counter to the direction of movement of said photoreceptor surface positioned adjacent to the area of the photoreceptor surface to be cleaned and containing a plurality of magnets located inside the magnetic brush roll;

(b) a plurality of magnetic, electrically conductive carrier particles having a resistivity of less than about $10^{10}$ ohm-cm and a triboelectric charging response of at least about 15 microcoulombs per gram of said toner particles magnetically adhering to said magnetic brush roll;

(c) a toner reclaim roll adapted to rotate counter to the direction of said magnetic brush roll positioned adjacent to the path of said magnetic brush roll so as to contact the carrier particles having toner particles thereon;

(d) a scraper means positioned in contact with said toner reclaim roll to remove toner particles from said toner reclaim roll;

(e) a transporting means in contact with said scraper means for disposal of said toner particles;

(f) means for electrically biasing the magnetic brush roll to a voltage of between about 50 volts and about 400 volts to assist in attracting the residual toner particles from the photoreceptor and onto the carrier particles; and (g) means for electrically biasing the toner reclaim roll to a negative polarity of up to about 400 volts to assist in removing the toner particles from the carrier particles.

2. A magnetic brush cleaning system in accordance with claim 1 wherein said photoreceptor, said carrier particles, and said toner reclaim roll all triboelectrically charge said toner particles to the same polarity.

3. A magnetic brush cleaning system in accordance with claim 1 wherein said toner reclaim roll has a metal surface.

4. A magnetic brush cleaning system in accordance with claim 1 wherein said magnetic brush roll is transported at a speed of between about 6 inches and about 14 inches per second.

5. A magnetic brush cleaning system in according with claim 1 wherein said toner reclaim roll is rotated at a speed of about 6 inches per second.

6. A magnetic brush cleaning system in accordance with claim 1 wherein said carrier particles comprise a core having a gritty, oxidized surface which is at least partially overcoated with a resinous material as to provide said carrier particles with a resistivity of between about $10^7$ ohm-cm and about $10^{10}$ ohm-cm.

7. A magnetic brush cleaning system in accordance with claim 6 wherein said resinous material is halogenated and is selected from the group consisting of polyvinyl chloride-trifluorochloroethylene, polyvinylidene fluoride, polyvinylidene fluoride-tetrafluoroethylene, vinylidene fluoride-chlorotrifluoroethylene, and vinyl chloride polymers.

8. A magnetic brush cleaning system in accordance with claim 1 wherein said carrier particles acquire a negative triboelectric charge and said toner particles acquire a positive triboelectric charge.

9. A magnetic brush cleaning system in accordance with claim 1 wherein the compacted pile height of said carrier particles is maintained at between about 0.080 inches and about 0.120 inches at the interphase between said photoreceptor surface and said magnetic brush roll.

10. A magnetic brush cleaning system for removing residual toner particles from a photoreceptor surface in an electrostatographic copying/duplicating machine, said cleaning system comprising:

(a) a magnetic brush roll adapted to rotate counter to the direction of movement of said photoreceptor surface positioned adjacent to the area of the photoreceptor surface to be cleaned and containing a plurality of magnets located inside the magnetic brush roll;

(b) a plurality of magnetic, electrically conductive carrier particles having a resistivity of less than about $10^{10}$ ohm-cm and a triboelectric charging response of at least about 15 microcoulombs per gram of said toner particles magnetically adhering to said magnetic brush roll;

(c) a toner reclaim roll adapted to rotate counter to the direction of said magnetic brush roll positioned adjacent to the path of said magnetic brush rolls as to contact the carrier particles having toner particles thereon;

(d) a scraper means positioned in contact with said toner reclaim roll to remove toner particles from said toner reclaim roll;

(e) a transporting means in contact with said scraper means for disposal of said toner particles;

(f) a preclean corotron and a preclean erasure light located prior to the area of the photoreceptor surface to be cleaned;

(g) means for electrically biasing the magnetic brush roll to a voltage of between about 50 volts and about 400 volts to assist in attracting the residual toner particles from the photoreceptor and onto the carrier particles; and (h) means for electrically biasing the toner reclaim roll to a negative polarity of up to about 400 volts to assist in removing the toner particles from the carrier particles.

11. A magnetic brush cleaning system in accordance with claim 10 wherein said preclean corotron is excited with about a one milliampere AC current at a frequency of about four kilohertz and said preclean erasure light comprises an incandescent 60 watt lamp.

* * * * *